United States Patent [19]

Nishino et al.

[11] Patent Number: 4,767,597

[45] Date of Patent: Aug. 30, 1988

[54] HEAT-RESISTANT ALLOY

[75] Inventors: Kazuaki Nishino, Aichi; Takuo Ito, Gifu; Satosi Kato; Hidenori Yamaoka, both of Aichi, all of Japan

[73] Assignee: Kabushiki Kaisha Toyota Chuo Kenkyusho, Aichi, Japan

[21] Appl. No.: 729,782

[22] Filed: May 2, 1985

[30] Foreign Application Priority Data

May 2, 1984 [JP] Japan ..... 59-89100

[51] Int. Cl.[4] ..... C22C 19/05

[52] U.S. Cl. ..... 420/443; 420/448; 420/449; 420/450; 420/584

[58] Field of Search ..... 420/582, 584, 443, 446, 420/448, 449, 450; 148/410, 428, 419, 442

[56] References Cited

U.S. PATENT DOCUMENTS 3,048,485 8/1962 Bieber ..... 420/582

*Primary Examiner*—R. Dean

*Attorney, Agent, or Firm*—Sughrue, Mion, Zinn, Macpeak & Seas

[57] ABSTRACT

A heat-resistant alloy having excellent properties at high temperatures and useful for producing exhaust valves, comprises, in weight %, not more than 0.10% C, not more than 2.0% Si, not more than 2.0% Mn, from 35 to 50% Ni, from 17 to 25% Cr, from 3.2 to 5% Mo, from 2.0 to 3.2% Ti, from 0.5 to 1.5% Al, with the balance consisting essentially of Fe, wherein the weight ratio of Ti/Al is not more than 5/1. The alloy may further comprise at least one of B, Ca, and Mg, and/or at least one of Nb and Ta.

14 Claims, 1 Drawing Sheet

HEAT-RESISTANT ALLOY

FIELD OF THE INVENTION

The present invention relates to an alloy suitable for an exhaust valve in internal combustion engines, such as diesel engines and turbo-charger engines etc., or for a blade, a bolt and a shaft for turbines, which has excellent properties at high temperatures with respect to hardness, fatigue strength, creep strength, and sulfidation resistance.

BACKGROUND OF THE INVENTION

Hitherto, austenitic heat resistant steel of carbide-nitride precipitation strengthening type, represented, for example, by JIS (Japanese Industrial Standard) SUH 35 alloy (SAE EV8) has been widely used as a material available for exhaust valves used in gasoline or diesel engines. Recently, since internal combustion engines, such as turbocharger engines, etc., have been improved so as to generate higher power, a nickel base alloy, such as so-called Inconel 751 (trademark of International Nickel Co., corresponding to SAE HEV3, hereinafter simply referred to as alloy 751), which has excellent strength at high temperatures, has been used in place of the SUH35 for the aforesaid utilities.

Alloy 751 has excellent hardness at high temperatures, i.e. not lower than a hardness of Hv150 at 850° C., and a fatigue strength of 24 kg/mm$^2$ at 850° C. (at $10^7$ stress cycles). Thus, alloy 751 satisfies hardness at high temperatures and fatigue strength as an alloy for an exhaust valve to be used in aforesaid high power engines. On the other hand, alloy 751 has the drawbacks that it is expensive due to the high Ni content, i.e. 70%, and has poor sulfidation resistance at high temperatures as compared with above mentioned SUH35 alloy.

More recently, Incoloy 901 alloy, (trademark of International Nickel Co., hereinafter referred to as alloy 901) comprising 43Ni-13Cr-6Mo-3Ti-0.3Al has been proposed in order to surmount the foregoing defects by decreasing the Ni content to as low as 40 wt%, thereby lowering costs and improving sulfidation resistance at high temperatures.

Regardless of having a lower content of Ni, alloy 901 exhibits almost equal hardness at high temperatures to that of alloy 751 having not less than Hv150, but alloy 901 exhibits a lower fatigue strength than alloy 751, viz., 22 kg/mm$^2$ at $10^7$ stress cycles at 850° C. Furthermore, alloy 901 has a defect that the $\gamma'$ phase becomes unstable and $\eta$ phase ($Ni_3Ti$) is precipitated to embrittle the alloy, the creep strain rate is as large as $5\times10^{-3}$% $h^{-1}$ at stress of 7.0 kg/mm$^2$ thereby deforming a valve heat dishing into a cup form, and sulfidation resistance is not satisfactory.

As described above, prior known alloys do not fully satisfy desired properties with respect to hardness at high temperatures (e.g., 850° C.), fatigue strength, sulfidation resistance, and creep strain rate.

SUMMARY OF THE INVENTION

An object of the present invention is to provide an alloy useful for an exhaust valve suitable for use in a high power engine, which is excellent in hardness at high temperature, fatigue strength at high temperature, creep strain rate, and sulfidation resistance.

According to a first aspect of the present invention, there is thus provided a heat-resistant alloy for an exhaust valve having excellent properties at high temperature comprising, in weight %, not more than 0.10% C, not more than 2.0% Si, not more than 2.0% Mn, from 35 to 50% Ni, from 17 to 25% Cr, from 3.2 to 5% Mo, from 2.0 to 3.2% Ti, from 0.5 to 1.5% Al, and the balance consisting essentially of Fe (including unavoidable impurities), and has a weight ratio of Ti/Al of not more than 5/1.

According to a second aspect of the present invention, the alloy may further include at least one of from 0.0005 to 0.01% B, from 0.0005 to 0.02% Ca, and from 0.0005 to 0.02% Mg, for improving hot workability, and/or at least one of from 0.05 to 2.0% of Nb and from 0.05 to 2.0% of Ta, for improving strength by controlling grain size.

DETAILED DESCRIPTION OF THE INVENTION

Figure 1:
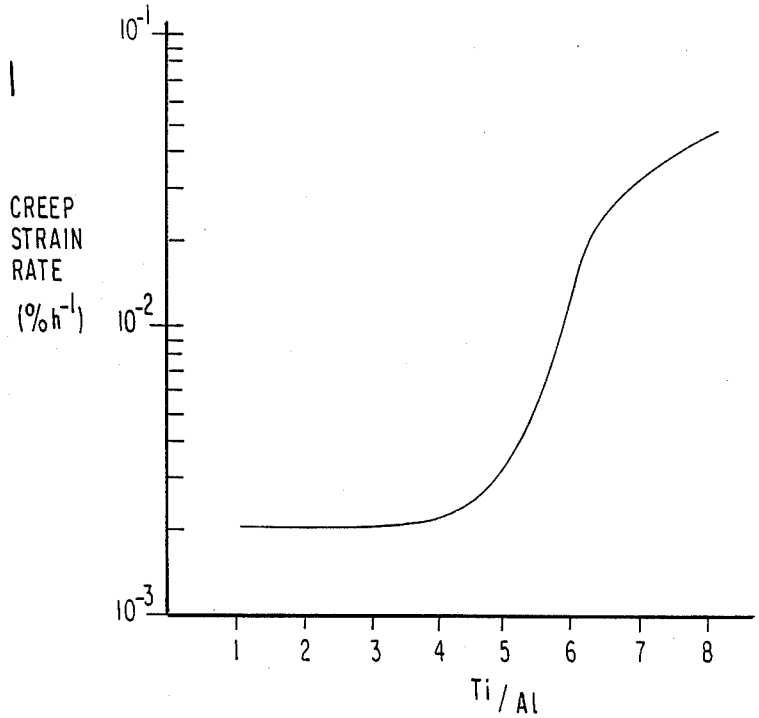
FIG. 1 shows a diagram of creep strain rate versus the ratio of Ti/Al of an alloy according to the present invention.

In consideration of the defects on the prior known steel, the present invention has been accomplished by studying on test results concerning a relation of creep strain rate versus amounts of Ti and Al, and the ratio of Ti/Al in an alloy of 40Ni-20Cr-3.5Mo-Fe. The inventors have found that, in an alloy having 2.0–3.2 wt% of Ti and 0.5–1.5 wt% of Al, a creep strain rate varies remarkably depending on the ratio of Ti/Al as shown in FIG. 1 and that the weight ratio of Ti/Al should be not more than 5/1 so as to obtain the creep strain rate of not more than $4\times10^{-3}$% $h^{-1}$ under a stress of 7.0 kg/mm$^2$.

Figure 2:
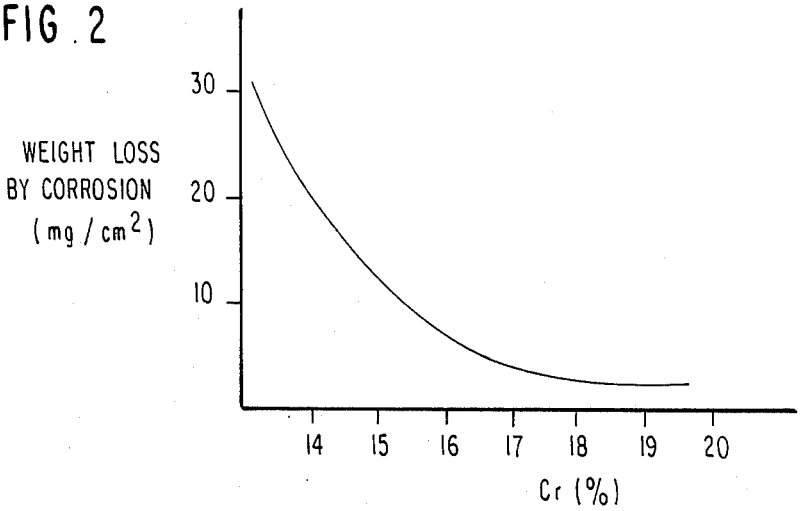
FIG. 2 shows a diagram of sulfidation resistance versus Cr content of an alloy according to the present invention.

Further, as a result of studying the effect of various components of an alloy 42Ni-3.5Mo-2.5Ti-1Al-Fe on sulfidation resistance at high temperatures, it has been found that the sulfidation resistance at high temperatures varies depending on the Cr content and the weight loss by corrosion is reduced with increasing Cr content as shown in FIG. 2, and thus the Cr content should be not less than 17 wt% so as to reduce the weight loss to not more than 5 mg/cm$^2$ at 800° C.

In consideration of the above findings, the alloy of the present invention has been successfully prepared by controlling the amounts of components of the 40 wt% Ni alloy so that the Ti and Al contents may be from 2.0 to 3.2 wt% and from 0.5 to 1.5 wt%, respectively, the weight ratio of Ti/Al being maintained at not more than 5/1, and the Cr content may be from 17 to 25 wt%. The resultant alloy has properties which are very comparable to those of Inconel 751 in hardness at high temperatures, fatigue strength at high temperatures, and creep strain rate. Furthermore, the alloy of the present invention is available as a material for an exhaust valve which is inexpensive and has excellent sulfidation resistance, the valve being suitable for high power engines.

The reasons for limiting the content of other constituents are described in detail below.

Carbon (C) is an element effective to be solution treated, forms an austenitic structure, and improves strength at high temperatures when combined with Ti, Cr, Mo, etc., to form carbides. However, since if C is present in an amount of more than 0.10 wt%, creep strength becomes lower and both toughness and ductility thereof may be deteriorated; thus the upper limit is defined as 0.10 wt%.

Silicon (Si) is an element effective to provide deoxidation activity, and improves an oxidation resistance and carburizing resistance. On the other hand, since if Si is contained over 2.0 wt% toughness and ductility properties will be deteriorated, an upper limit of the Si content is defined as 2.0 wt%.

Manganese (Mn) is also an element having a deoxidation activity. However, since if it is contained in an excessive amount, oxidation resistance at high temperatures thereof may be lowered, and therefore the upper limit of Mn content is defined as 2.0 wt%.

Nickel (Ni) is an element essential to stabilize an austenitic structure and to form $\gamma'$ phases [$Ni_3(Al, Ti)$], thereby maintaining the strength at high temperatures of the heat-resisting alloy. If the Ni content is less than 35 wt%, $\eta$ phase is liable to precipitate in the exhaust valve during practical use, causing degradation of the strength at high temperatures. Thus, 35 wt% is defined as the lower limit. On the other hand, the upper limit is defined as 50 wt%, since a higher content of Ni does not serve to further improve strength at high temperatures, but rather simply makes the alloy more expensive.

Chromium (Cr) is an element indispensable for securing properties such as oxidation resistance and sulfidation resistance at high temperatures, which are required for making an exhaust valve, and the Cr content should be at least 17 wt%. If Cr is contained excessively, $\sigma$ phase is formed over a long service period at high temperatures, thereby lowering creep strength as well as toughness and ductility. Accordingly, the upper limit is defined as 25 wt%. p Molybdenum (Mo) is an element effective to strengthen a base phase, prevents precipitate of $\eta$ phase ($Ni_3Ti$), and improves fatigue strength and creep strength. Mo should be contained in a content of at least 3.2 wt%. According to the finding that if it is contained in a content of more than 5 wt% $\sigma$ phase is precipitated to deteriorate creep strength as well as workability at high temperatures, the upper limit thereof is defined as 5 wt%.

Titanium (Ti) is also an element effective to combine with Ni and Al to thereby forms $\gamma'$ phases in an alloy and improve strength at high temperatures, and is required to be present in a content of not less than 2.0 wt%. If a Ti content of more than 3.2 wt% is present, strength at high temperatures is deteriorated due to precipitation of $\eta$ phase. The upper limit is accordingly defined as 3.2 wt%.

Aluminum (Al) is an essential element, as well as Ti, to form $\gamma'$ phase structure, and is required to be present at least 0.5 wt%. If Al is present in a content over 1.5 wt%, toughness, ductility, and hot workability are lowered. An upper limit is thereby determined as 1.5 wt%.

As stated in the foregoing, the ratio of Ti/Al remarkably influences the creep strain rate. According to the present invention, it is an object to obtain a creep strain rate of not more than $4\times10^{-3}\%\ h^{-1}$ under a stress of 70 kg/mm$^2$. A weight ratio of Ti/Al is therefore limited to not more than 5/1.

Boron (B), calcium (Ca), and magnesium (Mg), are elements effective to strengthen crystal grain boundaries and improve hot workability while further improving strength at high temperatures. These are preferably each present in a content of not less than 0.0005 wt%, respectively. However, if they are present in an amount more than required, low melting compounds are produced so that hot workability may be spoiled. Thus the upper limits of these elements are defined as 0.01 wt%, 0.02 wt%, and 0.02 wt% for B, Ca, and Mg, respectively.

Niobium (Nb) and tantalum (Ta) are useful elements to strengthen a matrix by solution treatment into an austenitic structure, and improve creep strength and ductility due to formation of carbides, and they inhibit grain boundary oxidation as well. Each of Nb and Ta is preferably present in a content of not less than 0.05 wt%, respectively. However, since either of these elements is liable to form $\sigma$ phase and thus to lower the creep strength, the upper limit for each is defined to be a maximum of 2.0 wt%.

The preferred embodiment of the present invention is to provide an alloy useful for an exhaust valve having excellent properties at high temperature.

The features of alloys according to the present invention are demonstrated as compared with prior art alloys and comparative alloys in following examples. Table 1 below shows the chemical components of these sample steels.

TABLE 1

| | Chemical Component (wt %) | | | | | | | | | | | | | | |
|---|---|---|---|---|---|---|---|---|---|---|---|---|---|---|---|
| Alloy | C | Si | Mn | Ni | Cr | Mo | Ti | Al | B | Ca | Mg | Hb | Ta | V | Ti/Al |
| A* | 0.03 | 0.13 | 0.05 | 71.4 | 15.3 | | 2.40 | 1.20 | | | | 0.91 | | | 2.0 |
| B* | 0.03 | 0.13 | 0.22 | 42.9 | 12.7 | 5.65 | 2.94 | 0.28 | 0.013 | | | | | | 10.5 |
| C** | 0.05 | 0.08 | 0.60 | 43.3 | 18.5 | 1.80 | 2.86 | 0.47 | 0.01 | | | | | | 6.1 |
| D** | 0.05 | 0.28 | 1.12 | 39.6 | 21.4 | 2.28 | 2.57 | 0.37 | 0.006 | | | | | 0.3 | 7.0 |
| E** | 0.05 | 0.13 | 0.50 | 42.1 | 15.12 | 2.96 | 2.92 | 0.85 | 0.007 | | | | | | 3.4 |
| F*** | 0.03 | 0.10 | 0.15 | 41.5 | 19.9 | 3.51 | 2.27 | 0.93 | | | | | | | 2.4 |
| G*** | 0.04 | 0.08 | 0.22 | 40.0 | 19.5 | 4.87 | 2.40 | 0.91 | | | | | | | 2.6 |
| H*** | 0.03 | 0.09 | 0.21 | 40.2 | 19.7 | 3.81 | 2.42 | 1.10 | 0.008 | | | | | | 2.2 |
| J*** | 0.03 | 0.15 | 0.58 | 41.52 | 19.35 | 3.67 | 2.40 | 1.12 | | 0.007 | 0.009 | | | | 2.1 |
| K*** | 0.03 | 0.19 | 0.46 | 39.26 | 18.82 | 3.51 | 2.53 | 1.07 | 0.005 | 0.009 | | | | | 2.4 |
| L*** | 0.04 | 0.09 | 0.53 | 41.25 | 18.52 | 3.62 | 2.51 | 0.92 | | | | 0.20 | 0.18 | | 2.7 |
| M*** | 0.04 | 0.07 | 0.55 | 41.26 | 19.41 | 3.73 | 2.37 | 0.96 | 0.010 | | | 0.24 | | | 2.5 |
| N*** | 0.03 | 0.13 | 0.43 | 43.28 | 20.68 | 3.42 | 2.47 | 1.05 | | 0.005 | 0.006 | 0.17 | 0.21 | | 2.4 |
| O*** | 0.04 | 0.11 | 0.35 | 40.63 | 19.85 | 3.65 | 2.89 | 0.63 | 0.007 | | | | | | 4.6 |

*Conventional alloy
**Comparative alloy
***Alloy of the present invention

In Table 1, alloys A and B are conventionally known, in which alloy A is so-called Inconel 751, (trademark), and B is Incoloy 901, (trademark); alloys C to E are comparative alloys; and alloys F to O are alloys according to the present invention.

Table 2 shows the test results on the properties, including hardness at high temperatures, fatigue strength at high temperatures, creep strain rate and sulfidation resistance. The tests were carried out on specimens made of each alloy listed in Table 1. The specimens are prepared by forming 30 kg ingot using a high frequency vacuum melting furnace, soaking at 1100° C. for 5 hours, hot-forging into a bar having 14 mm in diameter, and heat-treating with two air-cooling steps, at 1100° C. for 1 hour and subsequently at 750° C. for 4 hours.

A hardness strength test at high temperatures was carried out on the specimen having 5×5×10 mm of dimension which was heated at 850° C. and maintained under 300 g loading for 5 seconds in a vacuum condition, and a conventional microhardness tester was used to obtain a result.

A fatigue strength test was conducted on the specimen having 8 mm diameter and 20 mm gage length, at a revolution of 3,000 rpm at 850° C. in atmosphere using Krouse type rotary bending fatigue tester, by which a fatigue strength (at $10^7$ stress cycles) was tested.

TABLE 2

| Alloy | Hardness (Hv) 850° C. | Fatigue strength at $10^7$ stress cycles ($kg/mm^2$) 850° C. | Creep strength (850° C.) Strain rate ($\times 10^{-3}\%\ h^{-1}$) | Creep strength (850° C.) Rupture time (Hr) | Weight loss by corrosion ($mg/cm^2$) 800° C. |
|---|---|---|---|---|---|
| A* | 178 | 24.0 | 2.0 | 400 | 85.5 |
| B* | 161 | 22.0 | 4.8 | 550 | 30.6 |
| C** | 163 | 18.5 | 24.7 | 110 | 3.3 |
| D** | 160 | 17.8 | 33.0 | 150 | 4.8 |
| E** | 165 | 21.6 | 3.2 | 500 | 15.2 |
| F*** | 170 | 24.0 | 2.0 | 800 | 2.2 |
| G*** | 168 | 24.0 | 3.0 | 600 | 2.4 |
| H*** | 168 | 24.6 | 1.9 | 1000 | 0.9 |
| J*** | 172 | 24.2 | 2.1 | 750 | 2.0 |
| K*** | 168 | 24.3 | 2.3 | 800 | 2.2 |
| L*** | 173 | 24.7 | 1.8 | 1000 | 1.8 |
| M*** | 173 | 24.7 | 1.6 | 1200 | 2.1 |
| N*** | 175 | 24.9 | 1.5 | 1200 | 1.6 |
| O*** | 165 | 23.8 | 2.4 | 800 | 1.3 |

*Conventional alloy
**Comparative alloy
***Alloy of the present invention

A creep strength test was conducted on a prepared specimen having 5 mm diameter and 25 mm gage length by maintaining for a long period at 850° C. while applying a stress of 7 $kg/mm^2$. By measuring the ductility, a stationary strain rate and a lapse of time to rupture were obtained.

A sulfidation resistance test at high temperatures was conducted on a smooth specimen having 8 mm diameter and 15 mm length by applying as corrosion agent a composition comprising 90% $Na_2SO_4$ and 10% NaCl at a rate of 40 $mg/cm^2$, heating and holding it at 800° C. for 20 hours, and measuring the weight loss due to corrosion.

As seen in the Table 2, alloy A, prior known alloy, showed excellent hardness at high temperature, i.e., a hardness of approximately Hv180 at 850° C., which was satisfied for an alloy to be used for an exhaust valve of a high power engine; excellent fatigue strength at high temperatures, i.e. fatigue strength of 24.0 $kg/mm^2$ at 850° C. at $10^7$ stress cycles; and excellent creep strength, i.e. stationary creep strain rate of $2.0\times10^{-3}\%\ h^{-1}$ and lapse of time of 400 hours to rupture. Thus, alloy A has excellent properties at a high temperature of 850° C. in terms of hardness, fatigue strength and creep strength, while it is rather inferior in sulfidation resistance, showing weight loss of 85.5 $mg/cm^2$ at 800° C. which is relatively large.

On the other hand, alloy B, which is also known, showed excellent properties at high temperatures in hardness and fatigue strength, i.e. a hardness of approximately Hv 160 at 850° C. and fatigue strength of 22 $kg/mm^2$ at 850° C. at $10^7$ stress cycles, which was not so good as compared with alloy A. Regarding creep strength, alloy B showed a long lapse of time of 550 hours to rupture, and stationary creep strain rate of $4.8\times10^{-3}\%\ h^{-1}$, which was rather large. Thus, alloy B is inferior to alloy A in creep strength, and is lower in sulfidation resistance showing weight loss of 30.6 $mg/cm^2$.

Alloys C and D, which are comparative alloys, showed excellent hardness at high temperatures and sulfidation resistance, i.e. a hardness of Hv 163 and 160 at 850° C., and weight loss of 3.3 and 4.8 $mg/cm^2$ at 800° C., respectively, while they are inferior to the prior known alloys A and B, in terms of fatigue strength and creep strength due to lower Mo content, showing 1.80 wt% and 2.28 wt% respectively, lower Al content, and higher ratio of Ti/Al, showing 6.1 and 7.0 respectively. The fatigue strength of alloys C and D was rather low. Their fatigue strength (at $10^7$ stress cycles) was 18.5 $kg/mm^2$ and 17.8 $kg/mm^2$, respectively. The creep strength of both alloys was $24.7\times10^{-3}\%\ h^{-1}$ and $33.0\times10^{-3}\%\ h^{-1}$ respectively in terms of creep strain rate which was rather large, and in terms of lapse of time to rupture which was rather short.

Furthermore, alloy E, which is comparative alloy, showed excellent properties in hardness at high temperatures, fatigue strength and creep strength, showing a hardness of approximately Hv 165 at 850° C., fatigue strength of 21.6 $kg/mm^2$ at $10^7$ stress cycles, and stationary creep strain rate of not more than $3.2\times10^{-3}\%\ h^{-1}$. On the contrary, due to lower Cr content of 15.12 wt%, sulfidation resistance at high temperatures was lower than alloys C and D, showing weight loss of 15.2 $mg/cm^2$ at 800° C.

In comparison with the prior known alloys and comparative alloys described above, alloys F to O according to the present invention, due to the composition comprising about 40 wt% of Ni, 2.0–3.2 wt% of Ti, 0.5–1.5 wt% of Al, Ti/Al ratio being not more than 5/1, and further comprising not less than 17 wt% of Cr and not less than 3.2 wt% of Mo, exhibit excellent properties in hardness at high temperatures, fatigue strength, creep strength, and sulfidation resistance and are suitable for an exhaust valve of a high power engine. Namely, each alloy has a hardness of not less than Hv 168at 850° C., fatigue strength of not less than 24.0 $kg/mm^2$ at $10^7$ stress cycles in fatigue strength test, stationary creep strain rate of not more than $3.0\times10^{-3}\%\ h^{-1}$ and not shorter than 600 hours until final rupture in creep strength test, and weight loss of not more than 2.4 mg/cm$^2$ in sulfidation resistance.

Thus, it is seen that the alloy of the present invention exhibits the same or superior properties compared with those of Inconel alloy 751 and remarkably improves sulfidation resistance, which is one of the defects of the alloy 751. Thus, the alloy of the present invention is practically available for a material of an exhaust valve which is used in internal combustion engines, such as diesel engines, turbo-charger engines, and the like.

While the invention has been described in detail and with reference to specific embodiments thereof, it will be apparent to one skilled in the art that various changes and modifications can be made therein without departing from the spirit and scope thereof.

What is claimed is:

1. A heat-resistant alloy consisting essentially of not more than 0.10% by weight C, not more than 2.0% by weight Si, not more than 2.0% by weight Mn, from 35 to 50% by weight Ni, from 17 to 25% by weight Cr, from 3.2 to 5% by weight Mo, from 2.0 to 3.2% by weight Ti, from 0.5 to 1.5% by weight Al, with the balance consisting essentially of Fe, wherein the weight ratio of Ti/Al is not more than 5/1.

2. A heat-resistant alloy according to claim 1, wherein the Ni content is from 35 to 45% by weight.

3. A heat-resistant alloy according to claim 2, wherein the Mo content is from 3.5 to 4.2% by weight, and the weight ratio of Ti/Al is not more than 3.5/1.

4. A heat-resistant alloy according to claim 1, additionally containing at least one of from 0.0005 to 0.01% by weight B, from 0.0005 to 0.02% by weight Ca, and from 0.0005 to 0.02% by weight Mg.

5. A heat-resistant alloy according to claim 4, wherein the Ni content is from 35 to 45% by weight.

6. A heat-resistant alloy according to claim 5, wherein the Mo content is from 3.5 to 4.2% by weight, and the weight ratio of Ti/Al is not more than 3.5/1.

7. A heat-resistant alloy according to claim 1, additionally containing at least one of from 0.05 to 2.0% by weight Nb and from 0.05 to 2.0% by weight Ta.

8. A heat-resistant alloy according to claim 7, wherein the Ni content is from 35 to 45% by weight.

9. A heat-resistant alloy according to claim 8, wherein the Mo content is from 3.5 to 4.2% by weight, and the weight ratio of Ti/Al is not more than 3.5/1.

10. A heat-resistant alloy according to claim 4, further comprising at least one of from 0.05 to 2.0% by weight Nb and from 0.05 to 2.0% by weight Ta.

11. A heat-resistant alloy according to claim 10, wherein the Ni content is from 35 to 45% by weight.

12. A heat-resistant alloy according to claim 11, wherein the Mo content is from 3.5 to 4.2% by weight, and the weight ratio of Ti/Al is not more than 3.5/1.

13. A heat-resistant alloy according to claim 1, wherein the Mo content is from 3.2 to 4.87% by weight.

14. A heat-resistant alloy according to claim 1, wherein the weight ratio of Ti/Al is not more than 3.5/1.

* * * * *